US006219953B1

(12) United States Patent
Bentley

(10) Patent No.: US 6,219,953 B1
(45) Date of Patent: Apr. 24, 2001

(54) CLIP LOADING TOOL

(76) Inventor: Robert Bentley, 550 Fresno Ave., Morro Bay, CA (US) 93442

( * ) Notice: Subject to any disclaimer, the term of this patent is extended or adjusted under 35 U.S.C. 154(b) by 0 days.

(21) Appl. No.: 08/349,258

(22) Filed: Dec. 5, 1994

(51) Int. Cl.[7] ..... F41A 9/83
(52) U.S. Cl. ..... 42/90
(58) Field of Search ..... 42/87–90; 223/101

(56) References Cited

U.S. PATENT DOCUMENTS 1,235,605 * 8/1917 Sauer ..... 223/101
1,971,526 * 8/1934 Kempf ..... 42/89
3,956,844 * 5/1976 Misevich et al. ..... 42/90
4,706,402 * 11/1987 Csongor ..... 42/87
4,719,715 * 1/1988 Howard ..... 42/87
4,720,026 * 1/1988 Feuerman ..... 223/102
4,827,651 * 5/1989 Conkey ..... 42/87
4,869,009 * 9/1989 Bennett ..... 42/87
4,888,902 12/1989 Knowles .
4,993,180 * 2/1991 Upchurch ..... 42/87
5,355,606 * 10/1994 Origoni ..... 42/87

* cited by examiner

*Primary Examiner*—Charles T. Jordan
(74) *Attorney, Agent, or Firm*—Coudert Brothers

(57) ABSTRACT

A clip loading tool is provided for loading cartridges into a clip of a gun. The tool comprises a digit securing means for accommodating a digit of the user and a protrusion to enable the user to exert downward force on the casing of each of the individual cartridges by means of the user's digit, usually the thumb, to facilitate the loading of ammunition into the gun clip or magazine.

11 Claims, 2 Drawing Sheets

CLIP LOADING TOOL

BACKGROUND OF THE INVENTION

1. Field of the Invention

The invention relates to a device for loading cartridges into a clip of a firearm.

2. Description of the Prior Art

Most of the clips or magazines for rounds of ammunition for the numerous guns on the market use a spring loading mechanism. In such clips, a strong spring is mounted at the base of the clip within its body so that each successive round is ready for firing from the mouth of the clip. "Thumb busting" is the phrase used to describe what the average owner of clip fed guns must undergo each time a clip is loaded by hand. For example, the user's left thumb pushes the top cartridge down into the clip a slight distance. The upper edges of the clip prevent the top cartridge from being pushed too far into the clip. The upper edges of a clip curve inward to form the mouth which has a diameter that is slightly less than that of the cartridge. The user then takes the next cartridge in the right hand and uses it to push the nose of the bullet of the next cartridge further down into the clip. The only part of the top round in the clip that can be pushed down with the next round is the nose of the bullet because of the smaller diameter of the mouth of the clip. The top cartridge is now at a fairly sharp angle within the clip with its cup resting on the top of the clip. To finish loading the next round, one must push it at the same angle while pushing down on the spring until the next cartridge is within the body of the clip below the mouth.

Another difficulty with hand loading is that the last one-third of the shells become progressively harder to load as the spring become fully compressed. Pistols commonly have clips of about 10 to about 16 rounds. Clips for rifles and automatic guns have from about 20 up to 50 rounds. The spring resistance for a 16 round clip is quite strong. The larger clips for rifles and automatic guns are even harder to load as they approach their capacity. As a consequence, a number of tools for loading such clips by hand are readily available.

The clip loading tools presently in use are rather large and bulky. The prior art tools all tend to be approximately the size of the clip itself. The added weight and size of the prior art designs of clip loading tools make them inconvenient to carry as well as to use. Loose ammunition, i.e., ammunition that has not been loaded into a clip, is easier to carry to the practice range and has less bulk and weight than "clipped" ammunition. For the gun hobbyist, hunter or law enforcement personnel, a clip loading tool that can be easily carried in a pocket or on a gun belt saves time at the practice range. In addition, such a clip tool enables one to carry more ammunition on the belt and to carry less clips. This results in a savings of money for owners of clip fed pistols and rifles.

One example of such prior art clip loading tools is U.S. Pat. No. 4,888,902, issued Dec. 26, 1989. This patent discloses and claims a gun magazine loader which fits over a magazine and has approximately the same bulk and weight as the magazine.

These prior art clip loading tools are designed to load only one or two caliber cartridges and are usually restricted to loading a limited range of brands and models of guns. The smallest clip tool of the prior art designs is limited to loading 9 mm and 40 caliber ammunition; see a catalogue listing for an HKS Magazine Speed Loader. The most common clip loaders on the market load one or two guns and only one or two calibers of ammunition. The SaFariland™ loader fits 30 to 40 guns clips, but can only load two calibers of ammunition. One can choose from hundreds of models and makes of clip fed guns. There are numerous clip fed hunting rifles in bolt action, lever action and pump action which all use clips. Some of the semi-automatic hunting rifles are clip fed, but clip tools are designed for only a few of them. Because of this great variety of models and makes of clip fed guns and ammunition, there is a need for a clip tool which can be used for all of the ones in the gun owner's collection.

3. Advantages of the Present Invention

The clip loading device of the present invention has the following advantages over those of the prior art:

(a) To create a practical, small and non-complex loading tool having an aesthetically pleasing design.

(b) To create a loading tool which is very easy to carry.

(c) To provide a tool that can be used to load clips for clip fed guns of all models, makes and calibers of ammunition.

SUMMARY OF THE INVENTION

The present invention describes a device for loading cartridges into a clip of a gun comprising a digit securing means for accommodating a digit of the user and a protrusion to enable the user to exert a downward force on the case of each of the individual cartridges by means of the user's digit to facilitate the loading of ammunition into the gun clip or magazine.

The digit securing means has an upper member and a lower member. The upper member has an outer surface distal to the nail of the user's digit and an inner surface suitable for contact with a portion of the nail and the epidermis adjacent the nail of the user. The lower member has an inner surface suitable for contact with the digital pulp and an outer surface. The protrusion has a distal end and a proximal end protruding from the outer surface of the lower member of the digit securing means along an axis substantially transverse to digital pulp of the user. By exerting downward force on a casing with the distal end of the protrusion by means of the user's digit, preferably the user's thumb, the loading of ammunition into the magazine is facilitated. Preferably, the distal end of the protrusion is curved to accommodate the curvature of the case of each round of ammunition to be fed into the magazine.

Further objects, features and advantages of the device of the present invention will become apparent from a consideration of the drawings and the following description.

DETAILED DESCRIPTION OF THE INVENTION

Figure 1:
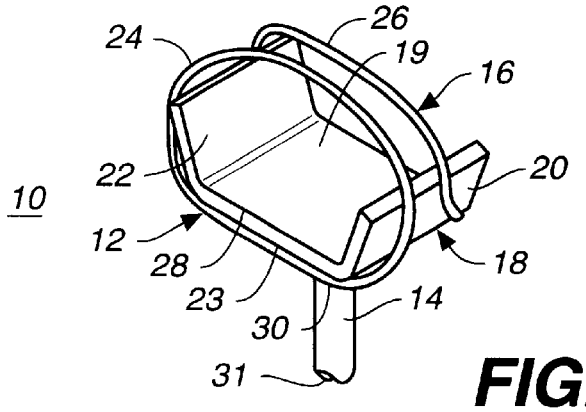
FIG. 1 is a top, front and side perspective view of one embodiment of the present invention.

Referring to FIG. 1, one embodiment of the present invention, clip tool 10, is shown having digit securing means 12 and protrusion 14. Digit securing means 12 comprises upper member 16 of an elastomeric material and lower member 18. Lower member 18 has bottom 19 and first and second sidewalls 20 and 22, which are integral with the respective ends of bottom 19. Protrusion 14 is centered in lower surface 23 of bottom 19. Protrusion 14 is attached by means of a suitable fastener to lower surface 23 so that it is transverse to surface 23. Upper member 16 is looped around protrusion 14 and first loop 24 of member 16 is looped over sidewalls 20 and 22 as shown. Similarly, second loop 26 is looped over sidewalls 20 and 22.

In the embodiments shown in FIGS. 2–5, tool 10 was constructed by bending a metal plate having a length of 1¼ inches and a width of ½ inch to form lower member 18 with first and second sidewalls 20 and 22, each having a height of approximately ½ inch, on each end of bottom 19 having a length of approximately ¾ inch and a width of ½ inch. Protrusion 14 was formed by threading a 1 inch sheet metal bolt, similar to that shown in FIG. 8, through a threaded countersunk hole so that the bolt head was flush with upper surface 28 of bottom 19. Alternatively, the head of the bolt can be placed so that it is flush with the countersunk hole and a nut, similar to that shown in FIG. 9, and is tightened against lower surface 28 to secure protrusion 14 to lower member 18. A copper pipe, shown as protrusion 14, that had an inner diameter substantially the same as the rod of the bolt, was urged over the threads and the rod of the bolt so that end 30 was against the nut. Distal end 31 of the periphery of copper tube was rounded to accommodate the curvature of a shell of a cartridge. The central region of distal end 31 was the end of the bolt. A resilient member such as washer 34 of an elastomeric material, was urged over the copper pipe to leave annular space 36 between washer 34 and the nut. Rubber band 16 was looped around the copper pipe within annular space 36. Rubber band 16 can be replaced by any elastomeric material, such as a natural rubber or synthetic rubber, e.g. butyl rubber, in the form of a band or tube. In this example, the rubber band was capable of being stretched to approximately 10 inches. Band 16 was formed into two loops, each capable of being stretched about 5 inches, and wrapped within annular space 36. One half of band 16 formed first loop 24 and was stretched over one end of sidewall 20. The other half of band 16 formed loop 26 and was stretched over the other end of sidewall 22. If desired, two notches (not shown) can be cut in the ends of sidewall 20 and sidewall 22 to provide a groove to keep band 16 in place. Lower surface 18 can consist of a soft metal, such as aluminum, brass and the like so that sidewalls 20 and 22 can be bent to increase or decrease the angle they make with bottom 19 depending on the size of the thumb or other digit of the user. In this way, clip tool 10 can accommodate any user.

Figure 5:
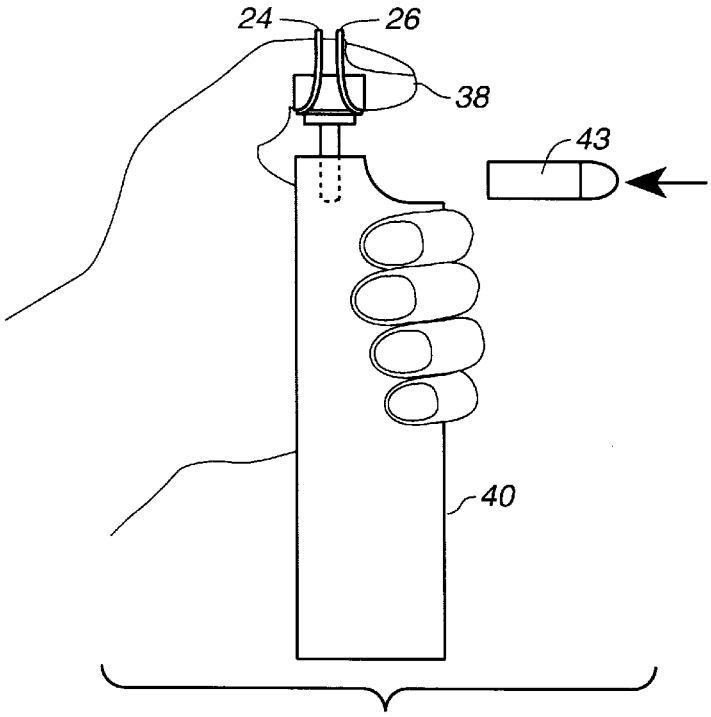

Thumb 38 of a user's hand (FIG. 5) was inserted through first loop 24 and second loop 26. Clip tool 10 was adjusted in a manner to position protrusion 14 directly under the center of the digital pulp of thumb 38. A right handed user took clip tool 10 and placed it over the left thumb and gripped clip 40 with the rest of the fingers of the user's hand as shown in FIG. 5. While protrusion 14 was being urged down against top cartridge 42 within clip 40, the user took next cartridge 43 in the right hand and easily pushed the cartridge into mouth 44 without having to fight spring 45. When cup 46 of next round 43 was partially lodged within mouth 43, protrusion 14 was lifted from cartridge 42 and placed adjacent nose 48 and slid toward cup 46. This action caused the round to slid in a horizontal direction until the cartridge was completely loaded into clip 40. After a little practice, the user loaded a 15 round clip in approximately in 20 seconds. This is to be compared with the time of about a minute without the use of the clip loading tool of the present invention.

Figure 6:
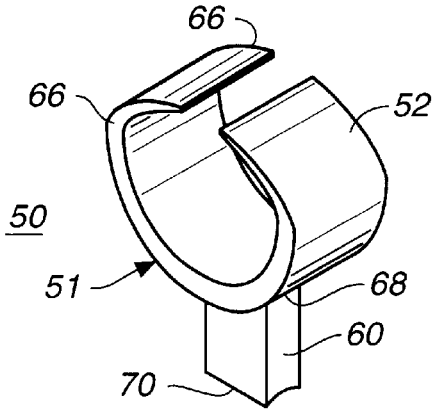
FIG. 6 is a top, front and side perspective view of the preferred embodiment of the present invention.
Figure 7:
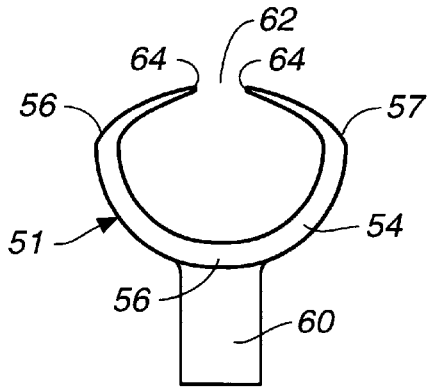
FIG. 7 is a side view of the preferred embodiment shown in FIG. 6.

FIGS. 6 and 7 illustrate the preferred embodiment of the present invention, clip tool 50, in which digit securing means 50 has upper member 52 and lower member 54. Upper member 52 has first section 56 and second section 57. Lower surface 58 of lower member 54 is integrally molded, e.g. by injection molding, with protrusion 60. The composition of clip tool 50 is a flexible plastic material designed so that spacing 62 between ends 64 of first section 56 and second section 57 can be flexed open to accommodate the thickness of the digit of the user in the same way that children's plastic rings once found in cereal boxes were placed on the children's fingers. However, unlike a child's ring, it is critical that first section 56 and second section 57 of digit securing means 51 of the present embodiment are designed to fit very tightly around the user's digit to prevent tool 50 from twisting around the digit when in use. As discussed above, side forces come into play when tool 50 slides across the case as the cartridge is being loaded into the clip. The type of plastic used must also have sufficient Izod impact strength to withstand rugged conditions placed on the tool during use. A few examples of suitable materials are acrylonitrile-butadiene-styrene (ABS), rubber modified polystyrene, specially formulated polyolefins and the like. Typical dimensions of upper member 51 of clip tool 50 include a diameter of approximately 1⅛ to 1¼ inch depending on the size of the user's digit and a distance between edges 66 of upper member 51 ranging from about ½ to about ⅝ inch. Protrusion 60 has a length of approximately ½ inch, a thickness of about ¼ to about 5/16 inch and a reach from proximal end 68 to curved distil end 70 of about ½ inch. Under normal situations, clip tool 50 is designed to fit two to three different sized thumbs.

Figure 8:
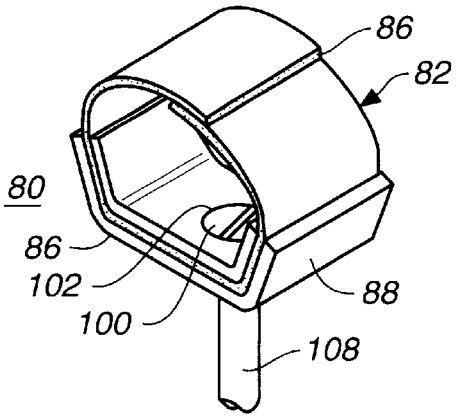
FIG. 8 is a top, front and side perspective view of still another embodiment of the present invention.
Figure 9:
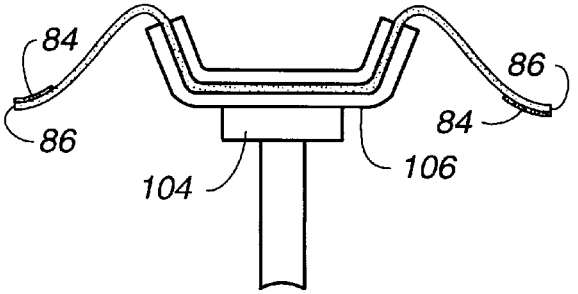
FIG. 9 is a side view of the embodiment shown in FIG. 8.
Figure 2:
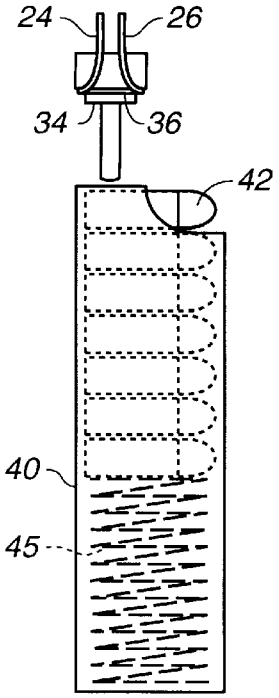
FIG. 2 is a side view of an embodiment of the present invention and a clip, partially in cross-section, as a round of ammunition is being loaded into the clip.
Figure 3:
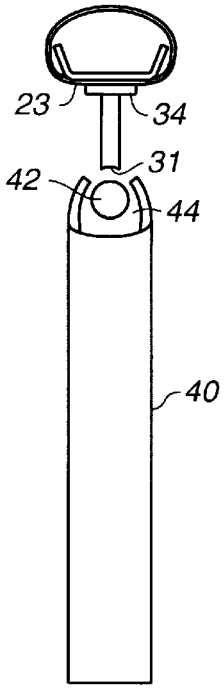
FIG. 3 is a front view of the embodiment shown in FIG. 2 and a clip as a round of ammunition is being loaded into the clip.
Figure 4:
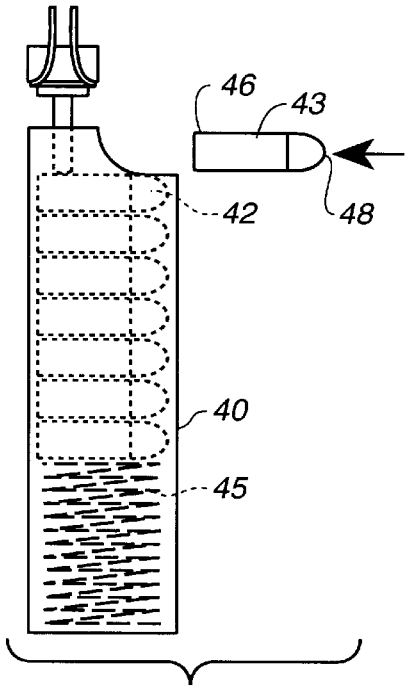
FIGS. 4 and 5 are side views of the embodiment shown in FIG. 2 and a clip as a round of ammunition is being loaded into the clip.

FIGS. 8 and 9 show another embodiment of the present invention, clip tool 80, which comprises upper member 82 made of an elastic material. The elastic material is sold as "elastic in casing" and comprises a heavy duty elastic encased with a durable cloth material such as nylon. The nylon casing is sewn onto the elastic material while the casing is bunched up or gathered together into folds. As the elastic is stretched to a certain point, the casing unfolds to its maximum extent. Upper member 82 has fastening means for fastening the material around the digit of the user. The means can include a variety of snaps and hooks to permit clip tool 80 to fit two or three different digits. However, the preferred fastening means is a synthetic hook and pile fastener, which adheres when pressed together, such as that sold under the trademark VELCRO. VELCRO hook and pile strips 84 on each end 86 of upper member 82 enable tool 80 to be used by all users.

Lower member 88 comprises upper plate 90 and lower plate 92 each having first and second sidewalls 94 and 96 and bottom 98 substantially as described above in connection with FIGS. 2–5. Upper member or elastic in casing 82 is placed between upper and lower plates 90 and 92 as shown in FIG. 8 and bolt 100 is inserted through countersunk hole 102 in upper plate 90 and a hole (not shown) in lower plate 92. Nut 104 is tightened against lower surface 106 of bottom 90 of lower plate 92. Protrusion 108 in the form of a pipe of a soft metal, such as aluminum, brass and the like is forced over bolt 100 as discussed above in connection with FIGS. 2–5. Alternatively, upper plate 90, upper member 82 and lower plate 92 can be riveted together and protrusion 108 welded or otherwise attached to lower surface 106. In place of the elastic in casing, a plastic or hard rubber or similar material can be used. It is also apparent to one skilled in the art that the digit securing means can be a continuous band designed to fit only one size of the user's digit.

Further, without departing from the spirit and scope of this invention, one of ordinary skill in the art can make many other changes and modifications to the present invention to adapt it to specific usages and conditions. As such, these changes and modifications are properly, equitably, and intended to be, within the full range of equivalents of the following claims.

What is claimed is:

1. A device for loading rounds of ammunition into a magazine of a gun comprising:

a digit securing means for fitting tightly around a digit of the user during use, said digit securing means having
an upper member having the upper section of a tubular elastic material having an upper section and a lower section, said upper section having
an outer surface distal to the nail of the digit, and
an inner surface suitable for contact with at least the epidermis adjacent the nail, and
a lower member comprising a metal, having
a bottom section, and
first and second side walls on each end of said bottom section; said bottom and first and second side walls having
an inner surface suitable for contact with the digital pulp of the digit, and
an outer surface;

a protrusion comprising a soft metal selected from the group consisting of copper, aluminum, brass and mixtures thereof fixedly attached to the outer surface of said bottom section, said protrusion having
a proximal end protruding from the outer surface of said bottom section along an axis substantially transverse to digital pulp of the user, and
a distal end curved to accommodate the case of each round of ammunition;

and a resilient member comprising an elastomeric material mounted on said protrusion below the lower surface of said bottom section, wherein the lower section of said tubular elastic material is looped around said protrusion between the lower surface of said bottom section and said resilient member, and whereby exerting downward force on a cartridge case with said distal end of said protrusion by means of the user's digit facilitates loading of a next round of ammunition into the magazine of a gun.

2. The device of claim 1 wherein the digit is a thumb.

3. The device of claim 1 wherein the tubular elastic member is a rubber band.

4. The device of claim 1 wherein the first and second side walls contain certain grooves to receive the tubular elastic material.

5. A device for loading rounds of ammunition into a magazine of a gun comprising:

a digit securing means for fitting tightly around the digit of the user during use, said digit securing means having
an upper member having
an upper section comprising an elastic material
and a lower section, said upper section having
a first end, and
a second end,
said upper section having
an outer surface distal to the nail of the digit, and
an inner surface suitable for contact with at least the epidermis adjacent the nail, and
fastening means for fastening said first end to said second end tightly around the digit of the user, and
a lower member comprising a metal, having
an upper plate having
a bottom section, and
first and second side walls on each end of said bottom section; said bottom and first and second side walls having
an inner surface suitable for contact with the digital pulp of the digit, and
an outer surface;
a lower plate having
a bottom section, and
first and second side walls on each end of the bottom section, said bottom and first and second side walls having
an inner surface, and
an outer surface; wherein said lower section of said elastic material is placed between the outer surface of said upper plate and the inner surface of said lower plate; and
means for joining said upper plate to said lower plate; and
a protrusion comprising a soft metal selected from the group consisting of copper, aluminum, brass and mixtures thereof fixedly attached to the outer surface of said bottom section of said lower plate of said digit securing means, having
a proximal end protruding from the outer surface of said lower plate along an axis substantially transverse to digital pulp of the user, and
a distal end curved to accommodate the case of each round of ammunition;

whereby exerting downward force on a cartridge case with said distal end of said protrusion by means of the user's digit facilitates loading of a next round of ammunition into the magazine of a gun.

6. The device of claim 5 wherein the fastening means comprises synthetic hook and pile fastener strips.

7. The device of claim 5 wherein said protrusion comprises a hollow sleeve comprising a soft metal selected from the group consisting of copper, aluminum, brass and mixtures thereof and having a tip distal from said bottom is curved to accommodate a casing of a round of ammunition to be loaded into the magazine of a gun and a bolt threaded through the bottom section and extending adjacent to the tip.

8. The device of claim 5 wherein the digit is a thumb.

9. A device for loading rounds of ammunition into a magazine of a gun comprising:

a digit securing means for fitting tightly around the digit of the user during use, said digit securing means having
an upper member having
an upper section comprising an elastic material and a lower section, said upper section having a first and a second end, said upper section having an outer surface distal to the nail of the digit, and an inner surface suitable for contact with at least the epidermis adjacent the nail of the digit, fastening means for fastening said first end to said second end tightly around the digit of the user, and a lower member comprising a plastic member, having a hollow channel for housing said lower section of said elastic material having an inner surface suitable for contact with the digital pulp of the digit, an outer surface, a protrusion comprising a rigid plastic bonded to the outer surface of said lower member, having a proximal end protruding from the outer surface of said lower member along an axis substantially transverse to digital pulp of the user, and a distal end, whereby exerting downward force on a cartridge case with said distal end of said protrusion by means of the user's digit facilitates loading of a next round of ammunition into the magazine of a gun.

10. The device of claim 9 wherein the digit is a thumb.

11. The device of claim 9 wherein the fastening means comprises synthetic hook and pile fastener strips.

* * * * *